US008535096B1

(12) United States Patent
Shirk et al.

(10) Patent No.: US 8,535,096 B1
(45) Date of Patent: Sep. 17, 2013

(54) DIE CAST CAGE FOR A RECEPTACLE ASSEMBLY

(75) Inventors: Michael Eugene Shirk, Grantville, PA (US); Matthew David Morrison, Hallifax, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 1 day.

(21) Appl. No.: 13/431,644

(22) Filed: Mar. 27, 2012

(51) Int. Cl.
*H01R 13/648* (2006.01)

(52) U.S. Cl.
USPC ..... 439/607.21; 439/374

(58) Field of Classification Search
USPC ..... 439/607.2, 607.21, 374
See application file for complete search history.

(56) References Cited

U.S. PATENT DOCUMENTS 6,416,361 B1 * 7/2002 Hwang ..... 439/607.2
6,430,053 B1 * 8/2002 Peterson et al. ..... 361/728
6,612,868 B2 * 9/2003 Hwang ..... 439/607.54
6,749,448 B2 6/2004 Bright et al.
6,816,376 B2 11/2004 Bright et al.
6,872,094 B1 3/2005 Murr et al.
7,090,523 B2 8/2006 Shirk et al.
8,123,559 B2 * 2/2012 Brown et al. ..... 439/607.21
8,396,757 B2 * 3/2013 Fellenstein et al. ..... 705/26.4

* cited by examiner

*Primary Examiner* — James Harvey

(57) ABSTRACT

A cage is provided for a receptacle assembly that includes a receptacle connector. The cage includes a die cast body having side walls that are spaced apart to define an internal compartment of the die cast body therebetween. The die cast body has a front end that is open to the internal compartment of the die cast body. The internal compartment is configured to receive the receptacle connector therein. The internal compartment is configured to receive a pluggable module therein through the front end. An alignment plate is mounted to the die cast body. The alignment plate includes an alignment segment that extends between the side walls to form a bottom wall of the cage. The alignment segment includes an alignment surface that defines a bottom boundary of the internal compartment of the die cast body.

20 Claims, 6 Drawing Sheets

DIE CAST CAGE FOR A RECEPTACLE ASSEMBLY

BACKGROUND OF THE INVENTION

The subject matter described and/or illustrated herein relates generally to transceiver assemblies.

Various types of fiber optic and copper based transceiver assemblies that permit communication between host equipment and external devices are known. Such transceiver assemblies include a pluggable module that is electrically connected to a host circuit board through a receptacle assembly. The receptacle assembly includes a metal cage (sometimes referred to as a "guide frame" or a "receptacle guide frame") having an internal compartment that is configured to receive the pluggable module therein. The receptacle assembly also includes a receptacle connector that is mounted to the host circuit board and extends within the internal compartment of the cage. As the pluggable module is loaded into the internal compartment of the cage, a plug of the pluggable module is received within a receptacle of the receptacle connector to pluggably connect the pluggable module to the receptacle connector and thereby establish an electrical connection between the pluggable module and the host circuit board.

But, the plug of the pluggable module may become misaligned with the receptacle of the receptacle connector as the pluggable module is loaded into the internal compartment of the cage. For example, the pluggable module may be angled downward toward the host circuit board as the pluggable module is loaded into the internal compartment, such that the plug aligns below the receptacle of the receptacle connector. Longer pluggable modules may be especially susceptible to misalignment because the longer module must travel farther within the internal compartment to reach the receptacle connector.

Misalignment of the plug and the receptacle may prevent the pluggable module and the receptacle connector from being electrically connected together, which prevents the pluggable module from electrically connecting to the host circuit board. Misalignment of the plug and the receptacle may jam the pluggable module within the internal compartment of the cage. Jamming of the pluggable module within the internal compartment of the cage may make it difficult to remove the pluggable module and/or properly align the plug with the receptacle. Jamming of the pluggable module may damage the pluggable module, the cage, and/or the receptacle connector.

A need exists for a transceiver assembly that promotes alignment of a pluggable module with a receptacle connector as the pluggable module is loaded into a cage of the transceiver assembly.

BRIEF DESCRIPTION OF THE INVENTION

In one embodiment, a cage is provided for a receptacle assembly that includes a receptacle connector. The cage includes a die cast body having side walls that are spaced apart to define an internal compartment of the die cast body therebetween. The die cast body has a front end that is open to the internal compartment of the die cast body. The internal compartment is configured to receive the receptacle connector therein. The internal compartment is configured to receive a pluggable module therein through the front end. An alignment plate is mounted to the die cast body. The alignment plate includes an alignment segment that extends between the side walls to form a bottom wall of the cage. The alignment segment includes an alignment surface that defines a bottom boundary of the internal compartment of the die cast body.

In another embodiment, a cage is provided for a receptacle assembly that includes a receptacle connector. The cage includes a die cast body having side walls that are spaced apart to define an internal compartment of the die cast body therebetween. The die cast body has a front end that is open to the internal compartment of the die cast body. The internal compartment is configured to receive the receptacle connector therein. The internal compartment is configured to receive a pluggable module therein through the front end. A bottom plate is mounted to the die cast body. The bottom plate includes a bottom segment that extends between the side walls to form a bottom wall of the cage. The bottom plate includes a latch member that is configured to cooperate with a latch feature of the pluggable module to latch the pluggable module to the cage.

In another embodiment, a transceiver assembly includes a pluggable module, and a receptacle assembly having a receptacle connector and a cage. The cage includes a die cast body having side walls that are spaced apart to define an internal compartment of the die cast body therebetween. The die cast body has a front end that is open to the internal compartment of the die cast body. The internal compartment is configured to receive the receptacle connector therein. The internal compartment is configured to receive the pluggable module therein through the front end. An alignment plate is mounted to the die cast body. The alignment plate includes an alignment segment that extends between the side walls to form a bottom wall of the cage. The alignment segment includes an alignment surface that defines a bottom boundary of the internal compartment of the die cast body.

DETAILED DESCRIPTION OF THE INVENTION

Figure 1:
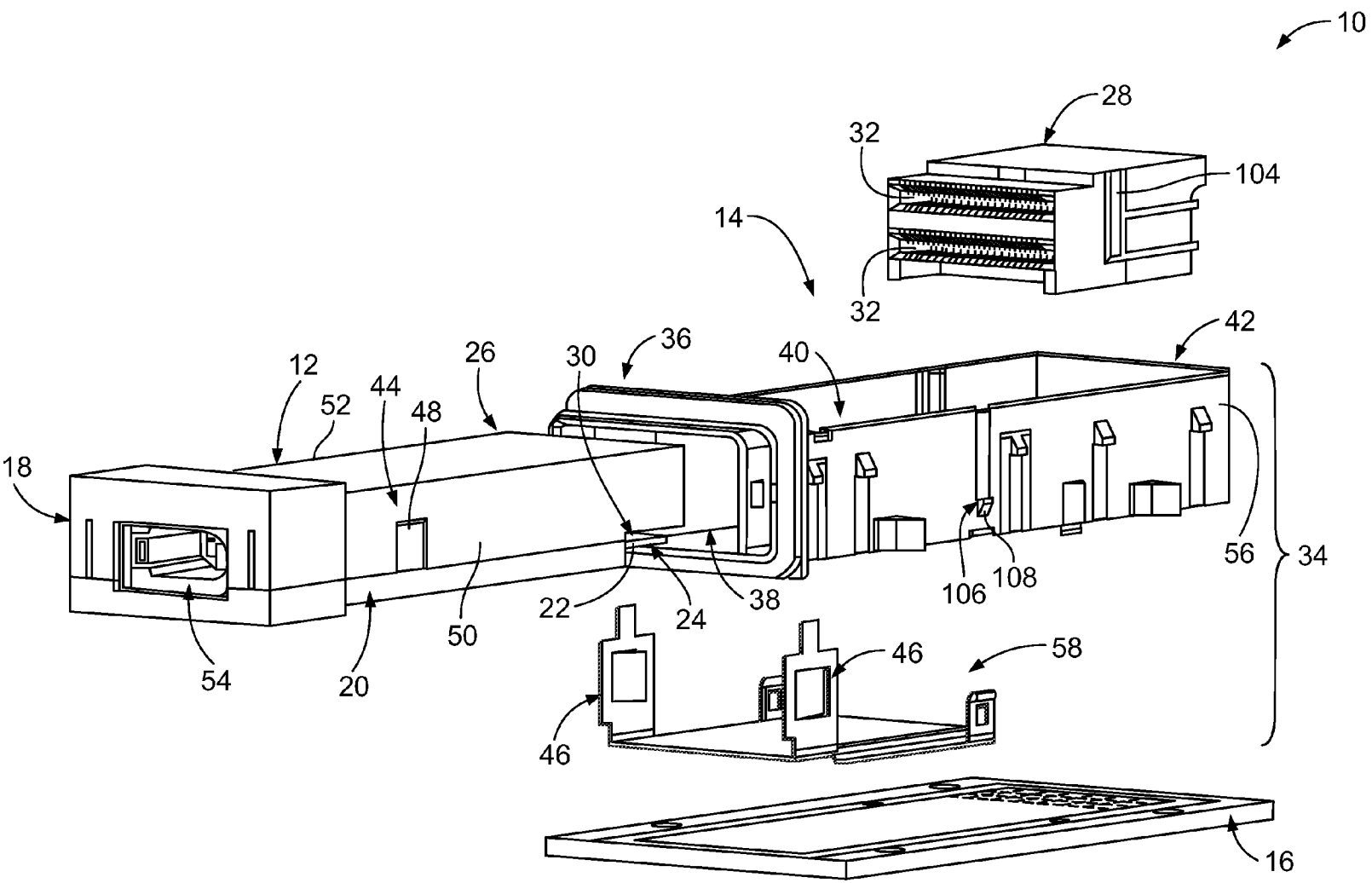
FIG. 1 is an exploded perspective view of an exemplary embodiment of a transceiver assembly.

FIG. 1 is a perspective view of a portion of an exemplary embodiment of a transceiver assembly 10. In the exemplary embodiment, the transceiver assembly 10 is adapted to address, among other things, conveying data signals at high rates, such as data transmission rates of at least 10 gigabits per second (Gbps), which is required by the SFP+ standard. For example, in some embodiments the transceiver assembly 10 is adapted to convey data signals at a data transmission rate of at least 28 Gbps. Moreover, and for example, in some embodiments the transceiver assembly 10 is adapted to convey data signals at a data transmission rate of between approximately 20 Gbps and approximately 30 Gbps. It is appreciated, however, that the benefits and advantages of the subject matter described and/or illustrated herein may accrue equally to other data transmission rates and across a variety of systems and standards. In other words, the subject matter described and/or illustrated herein is not limited to data transmission rates of 10 Gbps or greater, any standard, or the exemplary type of transceiver assembly shown and described herein.

The transceiver assembly 10 includes a pluggable module 12 configured for pluggable insertion into a receptacle assembly 14 that is mounted on a host circuit board 16. The host circuit board 16 may be mounted in a host system (not shown) such as, but not limited to, a router, a server, a computer, and/or the like. The host system typically includes a conductive chassis (not shown) having a panel (not shown) including one or more openings (not shown) extending therethrough in substantial alignment with the receptacle assembly 14. The receptacle assembly 14 is optionally electrically connected to the panel.

The pluggable module 12 is configured to be inserted into the receptacle assembly 14. Specifically, the pluggable module 12 is inserted into the receptacle assembly 14 through the panel opening such that a front end 18 of the pluggable module 12 extends outwardly from the receptacle assembly 14. The pluggable module 12 includes a housing 20 that forms a protective shell for a circuit board 22 that is disposed within the housing 20. The circuit board 22 carries circuitry, traces, paths, devices, and/or the like that perform transceiver functions in a known manner. An edge 24 of the circuit board 22 is exposed at a rear end 26 of the housing 20. In the exemplary embodiment, the circuit board 22 of the pluggable module 12 directly mates with a receptacle connector 28 of the receptacle assembly 14. In other words, the edge 24 of the circuit board 22 of the pluggable module 12 defines a plug 30 that is received within a receptacle 32 of the receptacle connector 28 to electrically connect the pluggable module 12 to the receptacle connector 28. Alternatively, a straddle mount connector (not shown) is mounted to the circuit board 22 and includes a plug (not shown) that is exposed at the rear end 26 of the housing 20 for plugging into the receptacle 32 of the receptacle connector 28. In the exemplary embodiment, the receptacle connector 28 includes two receptacles 32 and the pluggable module 12 includes two plugs 30 (only one plug 30 is visible herein) that plug into corresponding ones of the receptacles 32. But, the receptacle connector 28 may include any number of the receptacles 32 and the pluggable module 12 may include any number of the plugs 30.

In general, the pluggable module 12 and the receptacle assembly 14 may be used in any application requiring an interface between a host system and electrical and/or optical signals. The pluggable module 12 interfaces to the host system through the receptacle assembly 14 via the receptacle connector 28 of the receptacle assembly 14, which is located within an electrically conductive cage 34 (which is sometimes referred to as a "receptacle guide frame" or a "guide frame"). As illustrated in FIG. 1, the cage 34 includes a front end 36 having a front opening, or port, 38 that is open to an internal compartment 40 of the cage 34. The front end 36 of the cage 34 is configured to be mounted, or received, within the opening in the panel. The receptacle connector 28 is positioned within the internal compartment 40 at a rear end 42 of the cage 34. The receptacle connector 28 is mounted to the host circuit board 16 and extends through an opening in the bottom of the cage 34 such that the receptacle connector 28 is electrically connected to the host circuit board 16 from within the internal compartment 40. The internal compartment 40 of the cage 34 is configured to receive the pluggable module 12 therein in electrical connection with the receptacle connector 28.

The pluggable module 12 includes one or more latch features 44 for latching the pluggable module 12 to the cage 34. Each latch feature 44 cooperates with a corresponding latch member 46 of the cage 34 to latch the pluggable module 12 within the internal compartment 40 of the cage 34, as will be described below. In the exemplary embodiment, each latch feature 44 includes a recess 48 that extends into a side wall 50 of the housing 20 of the pluggable module 12. But, each latch feature 44 may additionally or alternatively include any other structure for cooperating with the corresponding latch member 46 of the cage 34, such as, but not limited to, an opening, an extension, a resiliently deflectable tab, a spring, and/or the like. In the exemplary embodiment, the pluggable module 12 includes two latch features 44. Specifically, although not visible in FIG. 1, a side wall 52 of the pluggable module housing 20 that is opposite the side wall 50 includes a latch feature 44. But, the pluggable module 12 may include any number of latch features 44.

The pluggable module 12 interfaces to one or more optical cables (not shown) and/or one or more electrical cables (not shown) through a connector interface 54 at the front end 18 of the module 12. Optionally, the connector interface 54 comprises a mechanism that cooperates with a fiber or cable assembly (not shown) to secure the fiber or cable assembly to the pluggable module 12. Suitable connector interfaces 54 are known and include adapters for the LC style fiber connectors and the MTP/MPO style fiber connectors offered by Tyco Electronics Corporation (Harrisburg, Pa.).

Although the cage 34 is shown as including only one internal compartment 40 and only one port 38 for electrically connecting a single pluggable module 12 to the host circuit board 16, the cage 34 may include any number of internal compartments 40 and ports 38, arranged in any pattern, configuration, arrangement, and/or the like (such as, but not limited to, any number of rows and/or columns), for electrically connecting any number of pluggable modules 12 to the host circuit board 16.

Figure 2:
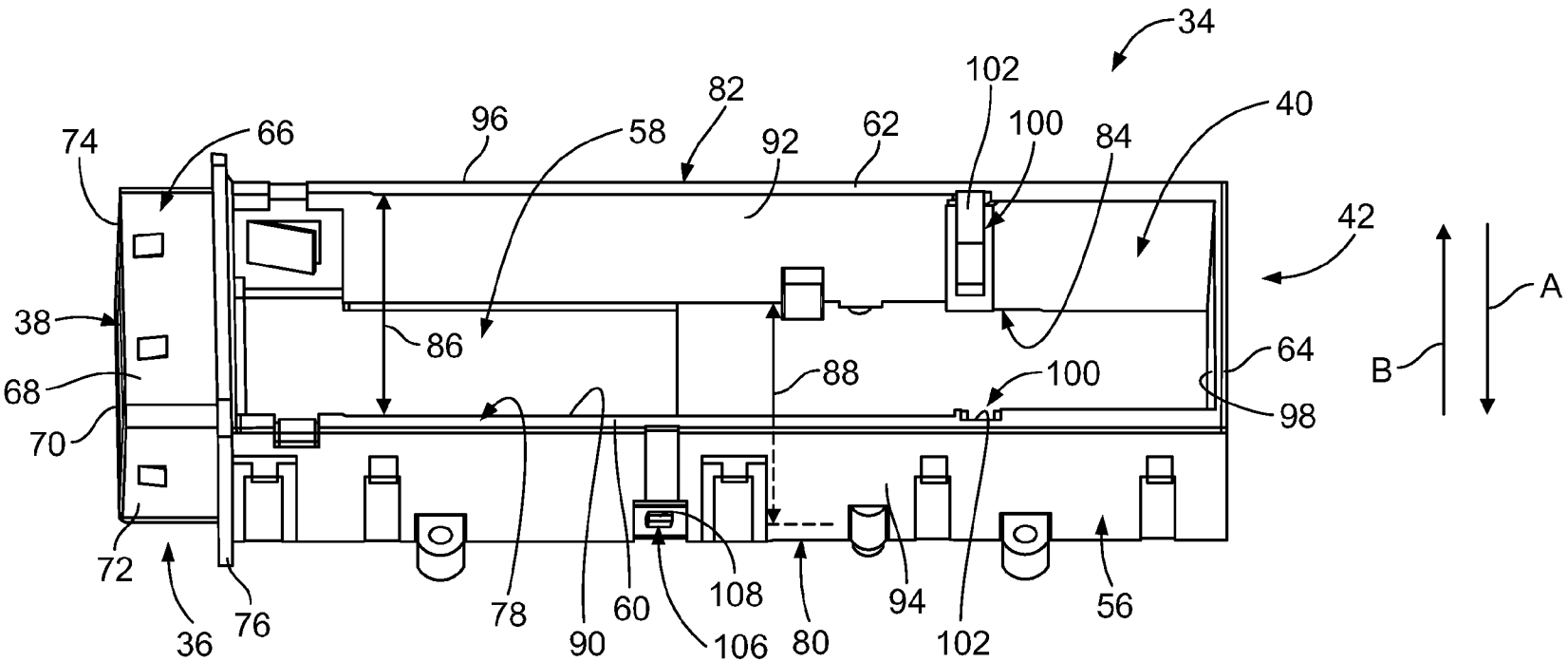
FIG. 2 is a perspective view of an exemplary embodiment of a cage of the transceiver assembly shown in FIG. 1.

FIG. 2 is a perspective view of an exemplary embodiment of the cage 34. The cage 34 includes an electrically conductive body 56 and a bottom plate 58 that is mounted to the body 56. The body 56 extends a length from the front end 36 to the rear end 42. The cage body 56 includes side walls 60 and 62 and the internal compartment 40. Specifically, the side walls 60 and 62 are spaced apart to define the internal compartment 40 therebetween. At the rear end 42, the body 56 includes a rear wall 64 that extends from the side wall 60 to the side wall 62. At the front end 36, the body 56 includes a bracket 66. The bracket 66 includes a top wall 68, a bottom wall 70, and opposite side walls 72 and 74 that each extend from the top wall 68 to the bottom wall 70. The bracket 66 includes the port 38 that is open to the internal compartment 40 of the body 56. The bracket 66 may include a flange 76. The flange 76 may engage the panel of the host system or may engage a gasket (e.g., an electromagnetic interference (EMI) gasket) that is engaged between the panel and the flange 76. The bottom plate 58 may be referred to herein as an "alignment plate".

The side wall 60 extends from a top end 78 to an opposite bottom end 80. The side wall 62 extends from a top end 82 to an opposite bottom end 84. The body 56 is mounted to the host circuit board 16 (FIG. 1) along the bottom ends 80 and 84 of the side walls 60 and 62. The body 56 includes a top opening 86 that extends between the top ends 78 and 82 of the side walls 60 and 62, respectively. The body 56 includes a bottom opening 88 that extends between the bottom ends 80 and 84 of the respective side walls 60 and 62. The cage 34 may include a top cover (not shown) that is configured to be mounted to the body 56 such that the top cover covers at least a portion of the top opening 86. In addition or alternatively to the top cover, a heat sink (not shown) may extend over the top opening 86 for thermal communication with the top cover and/or the pluggable module 12 (when the pluggable module 12 is received within the internal compartment 40).

The side walls 60 and 62 include interior sides 90 and 92, respectively. The interior sides 90 and 92 may stop sideways (e.g., in the directions of the arrows A and B, respectively) migration of the pluggable module 12 (FIGS. 1, 5, and 6) as the pluggable module 12 is loaded into the internal compartment 40. The side walls 60 and 62 include respective exterior sides 94 and 96. Each of the interior sides 90 and 92 defines a boundary of the internal compartment 40. Specifically, the interior sides 90 and 92 define opposing side boundaries of the internal compartment 40. An interior side 98 of the rear wall 64 defines another boundary of the internal compartment 40. Specifically, the interior side 98 of the rear wall 64 defines a rear boundary of the internal compartment 40. The interior sides 90 and/or 92 of the side walls 60 and 62, respectively, may include mounting structures 100 for holding the receptacle connector 28 (FIGS. 1 and 5) within the internal compartment 40. In the exemplary embodiment, the mounting structures 100 include slots 102 that receive corresponding extensions 104 (FIG. 1) of the receptacle connector 28 therein. But, in addition or alternatively to the slots 102, the mounting structures 100 may additionally or alternatively include any other mounting structure. Although two are shown, the body 56 may include any number of the mounting structures 100.

The body 56 includes one or more mounting features 106 for mounting the bottom plate 58 to the body 56, as will be described below. In the exemplary embodiment, each mounting feature 106 includes an extension 108 that extends outwardly from the exterior side 94 or 96 of the corresponding side wall 60 or 62, respectively. The mounting feature 106 can also be seen in FIGS. 1 and 4. In addition or alternatively to the extension 108, each mounting feature 106 may include any other structure that enables the bottom plate 58 to be mounted to the body 56, such as, but not limited to, an opening, a recess, and/or the like. Moreover, the mounting features 106 are not limited to being positioned on the side walls 60 and/or 62, nor are the mounting features 106 limited to being positioned on the exterior sides 94 and/or 96 of the side walls 60 and/or 62, respectively. Rather, each of the mounting features 106 may be positioned at any other location of the body 56 that enables the bottom plate 58 to be mounted to the body 56. For example, in some embodiments, a mounting feature 106 is positioned on the interior side 90 and/or 92 of a respective side wall 60 and/or 62. Although the body 56 includes two mounting features 106 in the exemplary embodiment, the body 56 may include any number of the mounting features 106.

The body 56 of the cage 34 may be a die cast body that is formed using a die cast process. In other words, the side walls 60 and 62, the rear wall 64, and the bracket 66 may be integrally formed using a die cast process.

Figure 3:
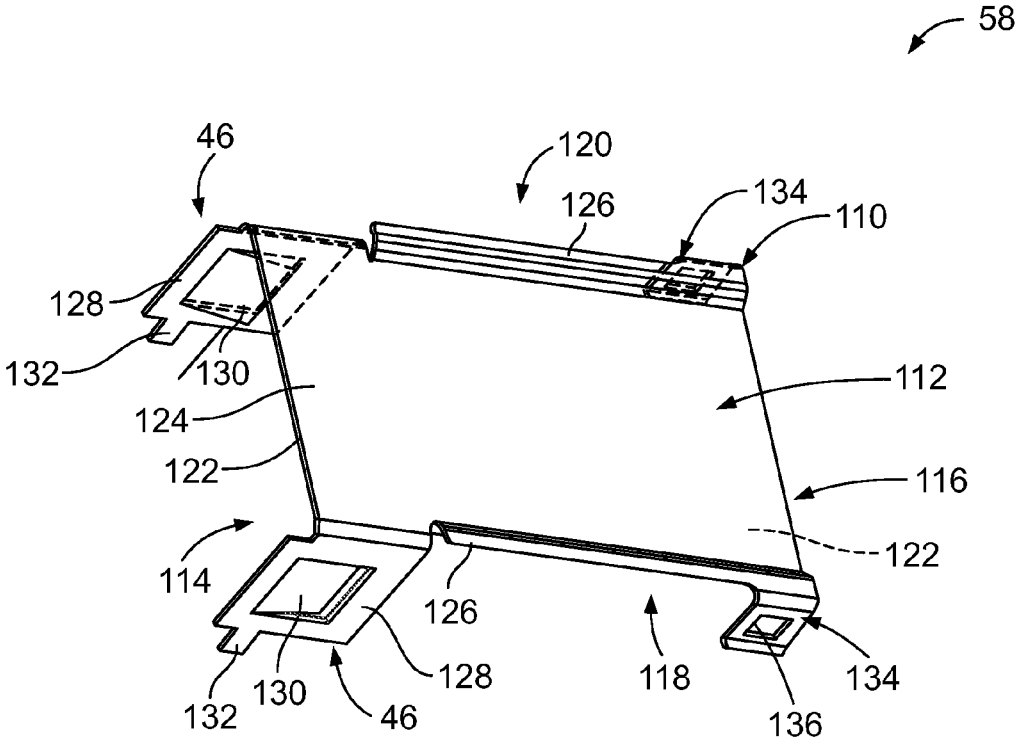
FIG. 3 is a perspective view of an exemplary embodiment of a bottom plate of the cage shown in FIG. 2.

FIG. 3 is a perspective view of an exemplary embodiment of the bottom plate 58. The bottom plate 58 includes a body 110 having a bottom segment 112. The body 110 may be electrically conductive. The bottom segment 112 extends a length from a front end 114 to an opposite rear end 116, and extends a width from a side 118 to an opposite side 120. The bottom segment 112 includes an alignment surface 122 and an opposite exterior surface 124. As will be described below, the bottom segment 112 forms a bottom wall of the cage 34 when the bottom plate 58 is mounted to the body 56 of the cage 34. The alignment surface 122 is configured to define a bottom boundary of the internal compartment 40 (FIGS. 1, 2, and 4-6) of the cage 34. Optionally, the body 110 of the bottom plate 58 includes one or more side rails 126 that extend outwardly along the sides 118 and/or 120 of the bottom segment 112. The bottom segment 112 may be referred to herein as an "alignment segment".

The bottom plate 58 includes the latch members 46 of the cage 34 that cooperate with the latch features 44 of the pluggable module 12 (FIGS. 1, 5, and 6) to latch the pluggable module 12 within the internal compartment 40 of the cage 34. In the exemplary embodiment, each latch member 46 includes a latch flange 128 that extends outwardly from the bottom segment 112. The latch flange 128 includes a resiliently deflectable latch tab 130. The latch tab 130 is configured to be received within the recess 48 of the corresponding latch feature 44 of the pluggable module 12 with a snap-fit connection. In addition or alternatively to the latch flange 128 and/or the latch tab 130, each latch member 46 may include any other structure for cooperating with the corresponding latch feature 44, such as, but not limited to, a recess, an opening, an extension, a spring, and/or the like. For example, in some embodiments, the latch flange 128 includes an opening and/or recess that receives an extension of the corresponding latch feature 44 therein, wherein the latch flange 128 and/or the extension is a spring such that the latch flange 128 and the extension cooperate with a snap-fit connection.

In the exemplary embodiment, the bottom plate 58 includes two latch members 46. But, the bottom plate 58 may include any number of latch members 46. The latch members 46 extend outwardly from the bottom segment 112 at the front end 114 in the exemplary embodiment. But, each latch member 46 may extend from the bottom segment 112 at any location along the length of the bottom segment 112. Optionally, the latch flanges 128 include mounting tabs 132 that facilitate mounting the bottom plate 58 to the body 56, as described below.

The body 110 of the bottom plate 58 includes one or more mounting flanges 134. Each mounting flange 134 cooperates with a corresponding mounting feature 106 (FIGS. 1, 2, and 4) of the body 56 (FIGS. 2, 4, and 6) to mount the bottom plate 58 to the body 56. In the exemplary embodiment, each mounting flange 134 includes an opening 136 that receives the extension 108 (FIGS. 1, 2, and 4) of the corresponding mounting feature 106 therein. Each mounting flange 134 is a spring such that the mounting flange 134 cooperates with the corresponding mounting feature 106 with a snap-fit connection. In addition or alternatively, the extension 108 of the corresponding mounting feature 106 is a spring.

In addition or alternatively to the mounting flanges 134 and/or the openings 136, the bottom plate 58 may include any other structure that enables the bottom plate 58 to be mounted to the body 56, such as, but not limited to, a recess, an extension, a resiliently deflectable tab, and/or the like. In the exemplary embodiment, the bottom plate 58 includes two mounting flanges 134. But, the bottom plate 58 may include any number of mounting flanges 134. The mounting flanges 134 extend outwardly from the bottom segment 112 at the rear end 116 in the exemplary embodiment. But, each mounting flange 134 may extend from the bottom segment 112 at any location along the length of the bottom segment 112.

The body 110 of the bottom plate 58 may be a cut and formed body 110 that is cut from a material and then formed to include the shape of the body 110. In such embodiments wherein the body 110 is a cut and formed body, the bottom plate 58 is considered to be a cut and formed bottom plate 58. Cutting processes include, but are not limited to, water cutting, stamping, laser cutting, punching, cutting using a saw, drill bit, plane, mill, and/or other solid cutting tool, and/or the like. Forming processes include, but are not limited to, drawing, bending, and/or the like. When the body 110 is fabricated using a cutting process, the body 110 may be cut from a reel of material, from a blank of material, from an approximately flat sheet of material, from an approximately flat material, from a rod of material, and/or the like.

Figure 4:
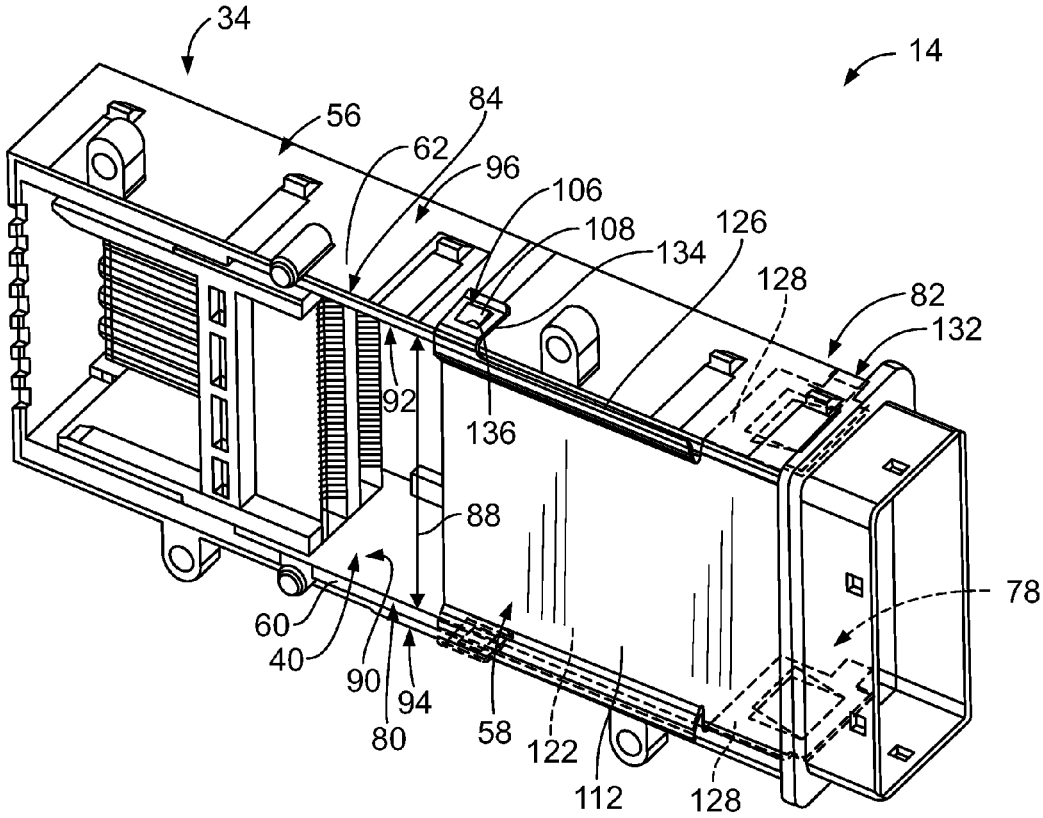
FIG. 4 is a perspective view of an exemplary embodiment of a receptacle assembly of the transceiver assembly shown in FIG. 1.

FIG. 4 is a perspective view of an exemplary embodiment of the receptacle assembly 14. FIG. 4 illustrates the bottom plate 58 of the cage 34 mounted to the body 56 of the cage 34. The bottom plate 58 is a discrete component (of the cage 34) relative to the body 56 of the cage 34. When mounted to the cage body 56 as shown herein, the latch flanges 128 of the bottom plate 58 extend along the interior side 90 or 92 of the corresponding side wall 60 and 62, respectively. The latch flanges 128 thus extend within the internal compartment 40. Alternatively, the latch flanges 128 extend along the exterior side 94 or 96 of the corresponding side wall 60 and 62, respectively. The mounting tabs 132 of the latch flanges 128 are folded over the top end 78 or 82 of the corresponding side wall 60 and 62, respectively, to facilitate holding the bottom plate 58 to the cage body 56.

The mounting flanges 134 of the bottom plate 58 extend along the exterior side 94 or 96 of the corresponding side wall 60 and 62, respectively. Alternatively, the mounting flanges 134 extend along the interior side 90 or 92 of the corresponding side wall 60 and 62, respectively. The mounting flanges 134 of the bottom plate 58 cooperate with the mounting features 106 of the body 56 with a snap-fit connection. The extensions 108 of the mounting features 106 are received within the openings 136 of the corresponding mounting flanges 134 to hold the bottom plate 58 to the body 56.

When the bottom plate 58 is mounted to the cage body 56, the bottom segment 112 extends between the side walls 60 and 62 to form a bottom wall of the cage 34. Specifically, the bottom segment 112 extends between the bottom ends 80 and 84 of the side walls 60 and 62, respectively, such that the bottom segment 112 covers at least a portion of the bottom opening 88 of the cage body 56. The alignment surface 122 thus forms a bottom boundary of the internal compartment 40.

In the exemplary embodiment, the bottom segment 112 extends approximately entirely across the width of the bottom opening 88 from the bottom end 80 of the side wall 60 to the bottom end 84 of the side wall 62, such that the bottom segment 112 covers an approximate entirety of the width of the bottom opening 88. But, the bottom segment 112 may extend across any amount and portion of the width of the bottom opening 88 such that the bottom segment 112 covers any amount and portion of the width of the bottom opening 88. As can be seen in FIG. 4, the side rails 126 extend over the bottom ends 80 and 84 of the corresponding side walls 60 and 62, respectively. The bottom segment 112 may cover any portion and amount of the length of the bottom opening 88 that enables the alignment surface 122 to function as described and/or illustrated herein.

Figure 5:
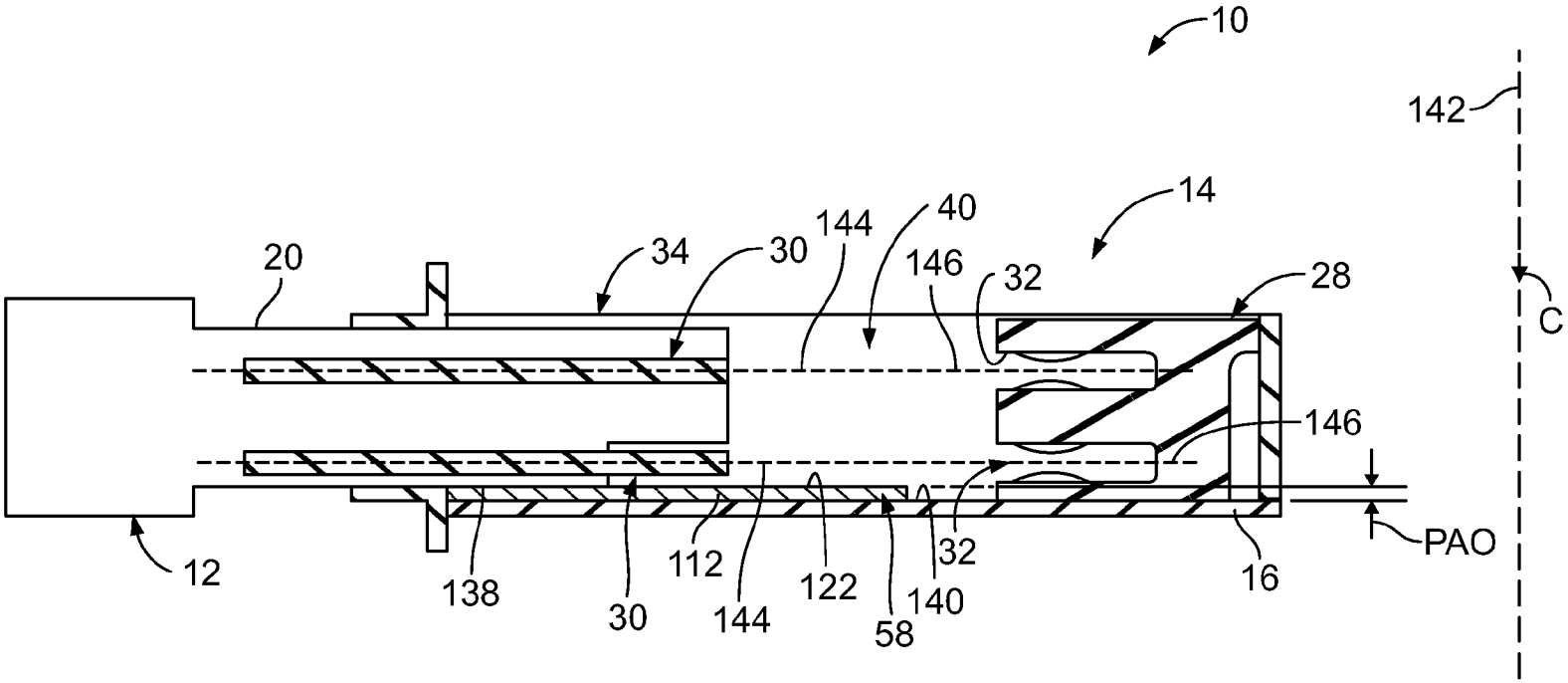
FIG. 5 is a partially exploded cross-sectional view of the transceiver assembly shown in FIG. 1.

FIG. 5 is a partially exploded cross-sectional view of the transceiver assembly 10. FIG. 5 illustrates the pluggable module 12 being loaded into the internal compartment 40 of the cage 34. The alignment surface 122 of the bottom segment 112 of the bottom plate 58 is configured to engage the pluggable module 12 as the pluggable module 12 is loaded into the internal compartment 40 of the cage body 56. Specifically, a bottom surface 138 of the housing 20 of the pluggable module 12 engages the alignment surface 122 of the bottom plate 58 as the pluggable module 12 is loaded into the internal compartment 40. The engagement between the alignment surface 122 and the pluggable module 12 aligns the pluggable module 12 with the receptacle connector 28 and/or maintains an alignment between the pluggable module 12 and the receptacle connector 28. Specifically, the engagement between the alignment surface 122 and the pluggable module 12 aligns, and/or maintains an alignment between, the plugs 30 of the pluggable module 12 and the receptacles 32 of the receptacle connector 28.

The receptacle assembly 14 (for example the cage 34 and the receptacle connector 28) are mounted on a surface 140 of the host circuit board 16. As can be seen in FIG. 5, the alignment surface 122 of the bottom segment 112 of the bottom plate 58 is offset from the surface 140 of the host circuit board 16 by a predetermined alignment offset PAO. The predetermined alignment offset PAO positions the alignment surface 122 relative to the receptacle connector 28 such that the alignment surface 122 extends at a predetermined alignment position relative to the receptacles 32 of the receptacle connector 28. The predetermined alignment position of the alignment surface 122 is selected such that when the bottom surface 138 of the pluggable module 12 is engaged with the alignment surface 122, the plugs 30 of the pluggable module 12 are aligned along an axis 142 with the corresponding receptacles 32 of the receptacle connector. Specifically, an axis 144 of each of the plugs 30 is aligned along the axis 142 with an axis 146 of the corresponding receptacle 32, as is shown in FIG. 5.

The engagement between the alignment surface 122 and the bottom surface 138 of the pluggable module 12 stops downward (e.g., along the axis 142 in the direction of the arrow C) migration of the pluggable module 12 as the pluggable module 12 is loaded into the internal compartment 40. The predetermined alignment position of the alignment surface 122, as well as the engagement between the module 12 and the surface 122, thus aligns, and/or maintains an alignment between, the plugs 30 of the pluggable module 12 and the receptacles 32 of the receptacle connector 28.

Figure 6:
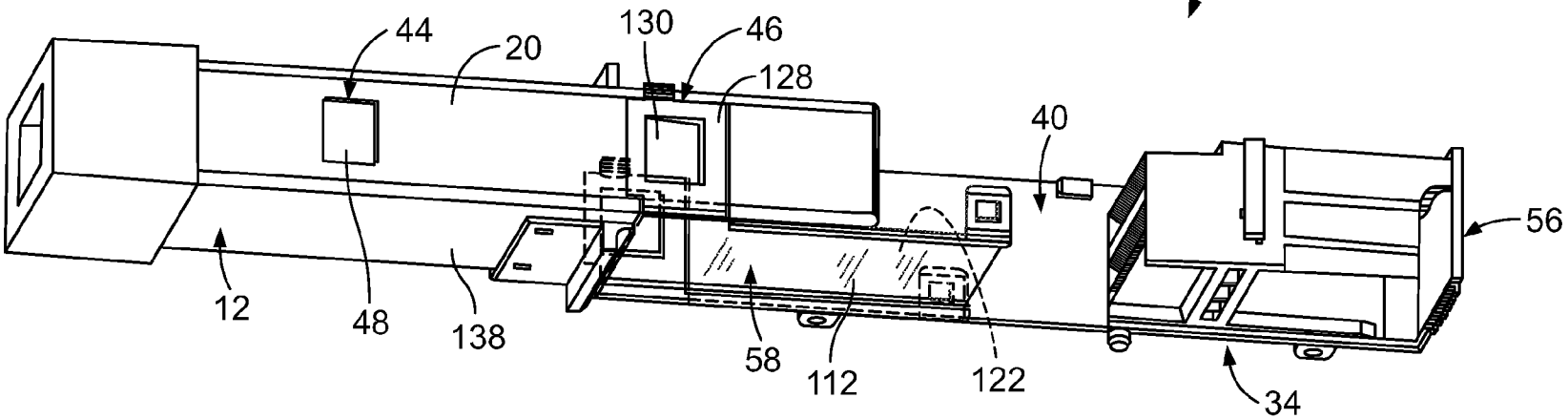
FIG. 6 is a partially broken-away and partially exploded perspective view of a portion of the transceiver assembly shown in FIGS. 1 and 5.

FIG. 6 is a partially broken-away and partially exploded perspective view of a portion of the transceiver assembly 10. The side wall 60 of the cage 34 has been removed from FIG. 6 for clarity. Similar to FIG. 5, FIG. 6 illustrates the pluggable module 12 being loaded into the internal compartment 40 of the cage 34. The engagement between the alignment surface 122 of the bottom plate 58 and the bottom surface 138 of the pluggable module 12 is also illustrated in FIG. 6.

The bottom plate 58 of the cage 34 is mounted to the body 56 of the cage 34 such that the latch flanges 128 of the latch members 46 of the bottom plate 58 are positioned to cooperate with the latch features 44 of the pluggable module 12. As the pluggable module 12 is loaded into the internal compartment 40 of the cage 34, the resiliently deflectable tabs 130 of the latch flanges 128 are deflected, against the bias thereof, via engagement with the housing 20 of the pluggable module 12. As the pluggable module 12 is fully received into the internal compartment 40, the resiliently deflectable tabs 130 are received into the recesses 48 of the latch features 44 with a snap-fit connection. The latch members 46 of the bottom plate 58 thus cooperate with the latch features 44 of the pluggable module 12 to latch the pluggable module 12 within the internal compartment 40 of the cage 34.

The embodiments described and/or illustrated herein may provide a transceiver assembly that promotes alignment of a pluggable module with a receptacle connector as the pluggable module is loaded into a cage of the transceiver assembly. The embodiments described and/or illustrated herein may provide a cage having an alignment feature and a latching feature that are integrated into the same component. For example, the bottom plate 58 of the cage 34 includes both the alignment surface 122 and the latch members 46.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A cage for a receptacle assembly that includes a receptacle connector, the cage comprising:

a die cast body comprising side walls that are spaced apart to define an internal compartment of the die cast body therebetween, the die cast body having a front end that is open to the internal compartment of the die cast body, the internal compartment being configured to receive the receptacle connector therein, the internal compartment being configured to receive a pluggable module therein through the front end; and an alignment plate mounted to the die cast body, the alignment plate comprising an alignment segment that extends between the side walls to form a bottom wall of the cage, the alignment segment comprising an alignment surface that defines a bottom boundary of the internal compartment of the die cast body.

2. The cage of claim 1, wherein the alignment surface of the alignment segment is configured to engage the pluggable module as the pluggable module is loaded into the internal compartment of the die cast body for at least one of aligning the pluggable module with the receptacle connector or maintaining an alignment between the pluggable module and the receptacle connector.

3. The cage of claim 1, wherein the side walls of the die cast body define side boundaries of the internal compartment that stop sideways migration of the pluggable module as the pluggable module is loaded into the internal compartment, and wherein the bottom boundary defined by the alignment surface of the alignment segment stops downward migration of the pluggable module as the pluggable module is loaded into the internal compartment.

4. The cage of claim 1, wherein the cage and the receptacle connector are configured to be mounted to a surface of a circuit board, the alignment surface of the alignment segment being offset from the surface of the circuit board by a predetermined alignment offset.

5. The cage of claim 1, wherein the receptacle connector includes a receptacle that is configured to receive a plug of the pluggable module therein, the alignment surface of the alignment segment extending at a predetermined alignment position relative to the receptacle of the receptacle connector.

6. The cage of claim 1, wherein the side walls of the die cast body comprise top ends and opposite bottom ends, the alignment segment of the alignment plate extending between the bottom ends of the side walls.

7. The cage of claim 1, wherein the side walls of the die cast body comprise top ends and opposite bottom ends, the die cast body comprising an opening that extends between the bottom ends of the side walls, the alignment segment of the alignment plate covering at least a portion of the opening.

8. The cage of claim 1, wherein the die cast body comprises a mounting feature, the alignment plate comprising a mounting flange that extends outwardly from the alignment segment, the mounting flange cooperating with the mounting feature to mount the alignment plate to the die cast body.

9. The cage of claim 1, wherein the alignment plate is a cut and formed alignment plate.

10. A cage for a receptacle assembly that includes a receptacle connector, the cage comprising:

a die cast body comprising side walls that are spaced apart to define an internal compartment of the die cast body therebetween, the die cast body having a front end that is open to the internal compartment of the die cast body, the internal compartment being configured to receive the receptacle connector therein, the internal compartment being configured to receive a pluggable module therein through the front end; and a bottom plate mounted to the die cast body, the bottom plate comprising a bottom segment that extends between the side walls to form a bottom wall of the cage, the bottom plate comprising a latch member that is configured to cooperate with a latch feature of the pluggable module to latch the pluggable module to the cage.

11. The cage of claim 10, wherein the latch member of the bottom plate comprises a resiliently deflectable latch tab that is configured to cooperate with the latch feature of the pluggable module with a snap-fit connection to latch the pluggable module to the cage.

12. The cage of claim 10, wherein the latch member of the bottom plate comprises a latch flange that extends outwardly from the bottom segment, the latch flange extending within the internal compartment of the die cast body.

13. The cage of claim 10, wherein the side walls of the die cast body comprise interior sides that define boundaries of the internal compartment of the die cast body, the latch member of the bottom plate comprising a latch flange that extends outwardly from the bottom segment and along the interior side of a corresponding one of the side walls.

14. The cage of claim 10, wherein the die cast body comprises a mounting feature, the bottom plate comprising a mounting flange that extends outwardly from the bottom segment, the mounting flange cooperating with the mounting feature to mount the bottom plate to the die cast body.

15. The cage of claim 10, wherein the bottom plate is a cut and formed bottom plate.

16. A transceiver assembly comprising:

a pluggable module; and a receptacle assembly comprising a receptacle connector and a cage, the cage comprising:

a die cast body comprising side walls that are spaced apart to define an internal compartment of the die cast body therebetween, the die cast body having a front end that is open to the internal compartment of the die cast body, the internal compartment being configured to receive the receptacle connector therein, the internal compartment being configured to receive the pluggable module therein through the front end; and an alignment plate mounted to the die cast body, the alignment plate comprising an alignment segment that extends between the side walls to form a bottom wall of the cage, the alignment segment comprising an alignment surface that defines a bottom boundary of the internal compartment of the die cast body.

17. The transceiver assembly of claim 16, wherein the alignment surface of the alignment segment engages the pluggable module as the pluggable module is loaded into the internal compartment of the die cast body for at least one of aligning the pluggable module with the receptacle connector or maintaining an alignment between the pluggable module and the receptacle connector.

18. The transceiver assembly of claim 16, wherein the side walls of the die cast body define side boundaries of the internal compartment that stop sideways migration of the pluggable module as the pluggable module is loaded into the internal compartment, wherein the bottom boundary defined by the alignment surface of the alignment segment stops downward migration of the pluggable module as the pluggable module is loaded into the internal compartment.

19. The transceiver assembly of claim 16, wherein the receptacle assembly is configured to be mounted to a surface of a circuit board, the alignment surface of the alignment segment being offset from the surface of the circuit board by a predetermined alignment offset.

20. The transceiver assembly of claim 16, wherein the side walls of the die cast body comprise top ends and opposite bottom ends, the die cast body comprising an opening that extends between the bottom ends of the side walls, the alignment segment of the alignment plate covering at least a portion of the opening.

* * * * *